US005095884A

United States Patent [19]

Mertens

[11] Patent Number: 5,095,884

[45] Date of Patent: Mar. 17, 1992

[54] ARROW REST APPARATUS

[76] Inventor: Greg A. Mertens, 4916 Henwick La., Jefferson City, Mo. 65109

[21] Appl. No.: 687,245

[22] Filed: Apr. 17, 1991

[51] Int. Cl.[5] ..... F41B 5/00

[52] U.S. Cl. ..... 124/44.5; 124/24.1

[58] Field of Search ..... 124/23.1, 24.1, 25.6, 124/35.2, 44.5, 86, 88, 90, 900

[56] References Cited

U.S. PATENT DOCUMENTS

| | | | |
|---|---|---|---|
| 3,108,584 | 10/1963 | Coe | 124/44.5 |
| 3,292,607 | 12/1966 | Hoyt, Jr. | 124/44.5 |
| 3,865,096 | 2/1975 | Troncoso, Jr. | 124/24.1 |
| 3,935,854 | 2/1976 | Troncoso, Jr. | 124/24.1 |
| 4,054,119 | 10/1977 | Hansen et al. | 124/24.1 |
| 4,324,221 | 4/1982 | Pack | 124/24.1 |
| 4,332,232 | 6/1982 | Troncoso, Jr. | 124/24.1 |
| 4,489,704 | 12/1984 | Troncoso, Jr. | 124/24.1 |
| 4,492,214 | 1/1985 | Kielhoffer | 124/24.1 |
| 4,542,731 | 9/1985 | Quartino | 124/24.1 |
| 4,592,332 | 6/1986 | Topping | 124/44.5 |
| 4,598,688 | 7/1986 | Paul et al. | 124/44.5 |
| 4,791,907 | 12/1988 | Corley | 124/44.5 |
| 4,809,670 | 3/1989 | Simo | 124/44.5 |
| 4,838,237 | 6/1989 | Cliburn | 124/44.5 |
| 4,899,716 | 2/1990 | Martin et al. | 124/44.5 |
| 4,947,823 | 8/1990 | Larson | 124/41.1 |

OTHER PUBLICATIONS

"Mach Flite 4" Advertisement, Bow and Arrow, 10/1986, p. 5.

"Bowhunters Warehouse" Catalog, pp. 37, 38.

*Primary Examiner*—Peter M. Cuomo

*Assistant Examiner*—John A. Ricci

*Attorney, Agent, or Firm*—Richard J. Grundstrom

[57] ABSTRACT

An arrow rest apparatus for use in archery which generally consists of: a mounting bracket, a carriage, multiple bushings contained within the carriage, a rotatable arm contained within the bushings, an arrow rest attached to the rotatable arm and a biasing spring to apply bias to the rotatable arm. The mounting bracket attaches the arrow rest apparatus to an archery bow. The carriage is attached to the mounting bracket. The multiple bushings are aligned and contained within the carriage and are separated by slotted openings. The rotatable arm is installed within the bushings. The arrow rest, generally consisting of hardened wire launching fingers or other type of arrow rest, is attached to the rotatable arm between the multiple bushings. A biasing spring mounted on the rotatable arm and carriage applies bias to the rotatable arm to hold the arrow rest in proper position and allowing the arrow rest to rotate as an arrow is shot from the bow.

20 Claims, 5 Drawing Sheets

ARROW REST APPARATUS

BACKGROUND OF THE INVENTION

The present invention relates to an arrow rest apparatus, and more particularly, to an arrow rest for use on an archery bow for accurately holding an arrow when aiming and for accurately guiding the arrow when shot.

When an arrow is shot from a bow, and more pronounced using the modern compound bows of today, it is subjected to a sudden propulsive force, which accelerates the arrow from a resting state to a possible several hundred feet per second almost instantaneous. This propulsive force combined with a sideways torque imparted to the arrow by the releasing of the string by the archer, causes the arrow to go through a series of bowing and flexing motions. The amplitude and frequency of these bowing and flexing motions have an effect of the aiming and accurate flight of the arrow.

The design of the arrow rest help the archer in aiming and accurately delivering the arrow. The well designed arrow rest considers the bowing and flexing action of the arrow as it is shot. The most pronounced bowing is immediately as the string is released. Thus, if the arrow rest does not consider this factor the arrow rest may not provide the archer with assistance in accurately delivering the arrow.

There are currently several types of arrow rest available. This includes plunger type arrow rests having a head for contacting the arrow and some sort of extension from the head upon which the arrow actually rests. Any sideways pressure exerted by the arrow on the head of the plunger type arrow rest is absorbed by the plunger action of the plunger. The extension generally pivots, rotates or bends as the arrow is shot.

There are also wire type of arrow rest which can be mounted on a spring, bracket or some sort of pivot arm. The wire arrow rest of these designs have various shapes and bends to accommodate an arrow. When an arrow is shot the wire can flex, pivot or rotate as the arrow bows or flexes.

In some instances the plunger and the wire type of arrow rests are combined. The plunger absorbing the sideways pressures and the wire arrow rest flexing, pivoting or rotating as the arrow passes. The type of arrow rest the archer uses is his choice. Many have preferences based upon experience with the various types available and the skill of the archer and the cost of the equipment.

The arrow rest of this invention provides the archer with a new and improved arrow rest. This arrow rest considers the bowing and flexing of the arrow as it is shot from the bow, allows the archer a variety of combinations of components, and allows for secure and easy adjustment of the arrow rest.

The primary object of this invention is to provide an arrow rest which will assist the archer in aiming and accurately shooting an arrow from a bow.

Another object of the arrow rest of this invention is to provide an arrow rest which can be easily adjusted, both horizontally and vertically.

Yet another object of the arrow rest of this invention is to provide an arrow rest which is stable and secure, such that once adjusted the arrow rest will maintain the setting during subsequent shooting and handling of the bow.

Still another object of the arrow rest of this invention is to provide an arrow rest which allows the archer a combination of components of the arrow rest in accordance with his desires and experience.

A further object of the arrow rest of this invention is to provide an arrow rest which can be easily installed and adjusted to fit most bows available on the market.

These and other objects and features of the present invention will be better understood and appreciated from the following, summary of the invention and detailed description of the main embodiments thereof, selected for purposes of illustration and shown in the accompanying figures.

SUMMARY OF THE INVENTION

To accomplish the foregoing and other objects of this invention there is provided an arrow rest apparatus for use in archery.

The arrow rest generally consists of a mounting bracket for attaching the arrow rest apparatus to an archery bow; a carriage attached to said mounting bracket; a plurality of bushings, the bushing being aligned and contained within the carriage; a rotatable arm installed within the bushings; an attachment means on the rotatable arm for attachment of an arrow resting means, such as hardened wire fingers; and a biasing means, the biasing means mounted on the carriage to apply bias to the rotatable arm.

In the preferred embodiment, the arrow rest contains three pivot bushings to keep the rotatable arm holding the arrow resting fingers perfectly aligned and for smoother operation and aiming. The multiple bushings also allows for a high degree of tolerance in maintaining the arrow resting means perfectly aligned. An easy adjustable internal spring is used to maintain tension for the pivoting of the arrow resting fingers. Individual set screws are used to maintain the arrow resting fingers in the proper placement. The horizontal position of the carriage in the attachment of the carriage to the mounting bracket provides for horizontal position and adjustment of the arrow resting fingers. No horizontal movement of the rotatable arm or the arrow resting fingers is required.

Vertical adjustment of the arrow resting fingers is provide with individual set screws contained within the rotatable arm. In the preferred embodiment, two wire arrow resting fingers are inserted into bores on the rotatable arm and are held securely by individual set screws. Vertical adjustment is provided by the vertical position of the fingers in the rotatable arm.

One of the arrow resting fingers can be used in conjunction with a plunger type arrow rest if desired by the archer. This allows a versatile arrow rest apparatus which can accommodate the various desires of the archer.

DETAILED DESCRIPTION

Figure 1:
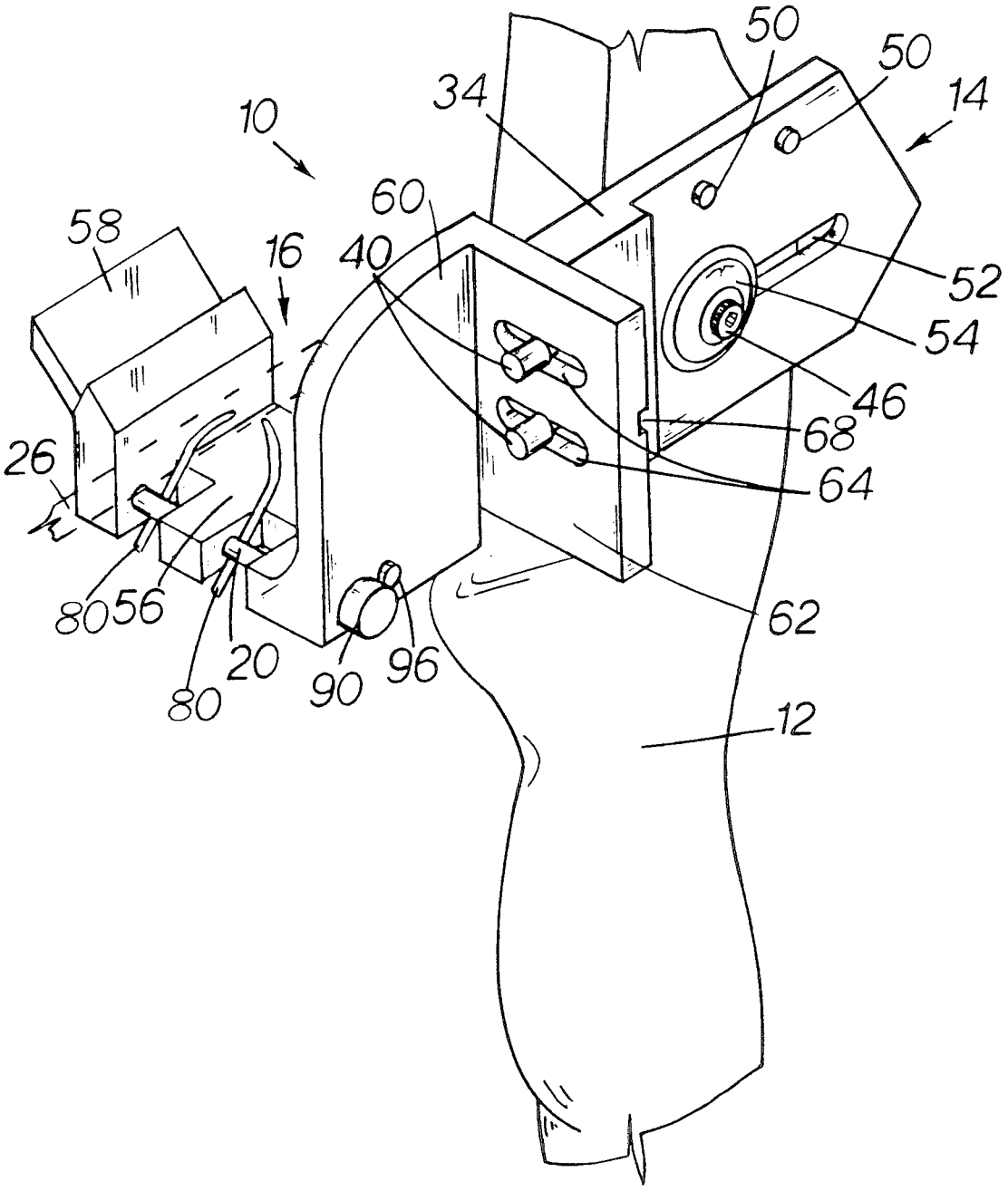
FIG. 1 illustrates the arrow rest apparatus installed on a bow.

Referring now to the drawings the drawing in general, there is shown the preferred embodiments for the arrow rest apparatus 10 of this invention for use in archery in conjunction with a bow.

Generally the arrow rest apparatus 10 consists of a mounting bracket 14 for attaching the arrow rest apparatus 10 to an archery bow 12; a carriage 16 attached to the mounting bracket 14; a plurality of bushings 18, the bushings 18 being aligned and contained within the carriage 16; a rotatable arm 20 installed in the bushings 18; an attachment means on said rotatable arm 20 for attachment of an arrow resting means 22 on the rotatable arm 20; and a biasing means 24, the biasing means 22 mounted on the carriage 16 to apply bias to the rotatable arm 20.

The mounting bracket 14 for attaching the arrow rest apparatus 14 to an archers's bow 12 generally consists of a rectangular structure 30. The rectangular structure 30 has a bow mounting area 32 and a carriage mounting block 34. The bow mounting area 32 being along an elongated section of said rectangular structure 30. The carriage mounting block 34 is a part of the rectangular structure 30 at one end of the bow mounting area 32 on the elongated section. The carriage mounting block 34 has a width wider then the bow mounting area 32. The wider width is to accommodate multiple threaded bores in the end 38 of the carriage mounting block 34. The threaded bores 36 receive carriage mounting bolts 40. In the preferred embodiment. the carriage mounting block contains two threaded bores 36.

The bow receiving area 32 contains an attachment means 42 for attaching the mounting bracket 14 to the bow 12. In one embodiment the attachment means 42 contains a plurality of bores 44. The bores 44 are for receiving a mounting bolt 46 for attaching the mounting bracket 14 to said archery bow 12, The bow mounting area 32 further has a small threaded bore 48 above each of the bores 44 for receiving a set screw 50. The set screws 50 are tightened against bow 12 to stabilize the arrow rest apparatus 10 on the bow 12.

In another embodiment, the attachment means 42 contains an elongated slotted bore 52. The slotted bore 52 receives a mounting bolt 46 for attaching the mounting bracket 14 to the bow 12. The bow mounting area 32 further having a plurality of small threaded bores 48. The small threaded bores being located above the slotted bore 52 for receiving a set screw 50 for stabilizing the arrow rest apparatus 10 on the bow 12.

The mounting bracket 14 is mounted on bow 12 by mounting bolt 46. The mounting bracket 14 is positioned, such that one of the bores 44 or the slotted bore 52 is over a threaded bore which is contained on the side of bow 12. A washer 54 is placed over the mounting bolt 46 and the mounting bolt 46 is placed through the bore 44 or slotted bore 52 and screwed into the threaded bore on bow 12. The mounting bolt 46 is tightened to secure the mounting bracket 14 to the bow 12. A set screw 50 is threaded into a threaded bore 48 on the bow receiving area 32 such that when tightened the set screw 50 will tighten against the bow 12. This further secures the position of the arrow rest apparatus 10 on bow 12 and prevents the arrow rest apparatus 10 from rotating on the bow 12 about mounting bolt 46.

The carriage 16 generally consists of a main body 56, a left side wall 58 extending at an angle from the left side of said main body 56, a right side wall 60 extending from the right side of said main body 56, and an attachment bracket 62 extending at a right angle from the right wall 60. The attachment bracket 62 has multiple bores 64 for receiving attachment bolts 40, to attach the carriage 16 to the threaded bores 36 on the carriage mounting block 34 on the mounting bracket 14.

In the preferred embodiment, the bores 64 in attachment bracket 62 are slotted bores. The slotted bores 64 allow for the horizontal adjustment of carriage 16 on the mounting bracket 14. Thus, this provides for the horizontal adjustment of the arrow rest apparatus 10. In the embodiment shown and illustrated, the attachment bracket 62 contains two slotted bores 64 and two threaded bores 36 on the carriage receiving block 34. In other embodiments, multiple bores 64 or any other acceptable substitute could be provided as a means to attach the carriage 16 and provide for the horizontal adjustment.

An adjusting apparatus common in the art could be added to provide for fine horizontal adjustment. The adjusting apparatus is simply an adjustment fixture attached to the adjustment bracket 62 and the mounting bracket 14. A threaded adjustment bolt rotatable installed in the adjustment fixture can rotate within the fixture without moving from the initial position. The threaded section of the threaded adjustment bolt is attached to the mounting bracket 14 in such a manner that as the bolt rotates the carriage 16 moves in a horizontal relationship to the rotation. In this embodiment the horizontal adjustment can be easily and accurately achieved. Once the desired position the attachment bolts 40 are tightened to securely hold the carriage in position. The adjusting apparatus is not a part of this invention, therefore, it is not further described or illustrated. Rather, it is mentioned because it is common in the art and can be easily adapted and installed on the arrow rest apparatus of this invention without departing from the scope and spirit of this invention.

The left side wall 58 in carriage 16 functions as a guard to prevent an arrow 26 being shot from bow 12 from falling off the carriage 16. An arrow 26 falling off the arrow rest apparatus as it is being shot could result in injury to the archer in addition to being a "wild" shot.

Figure 2:
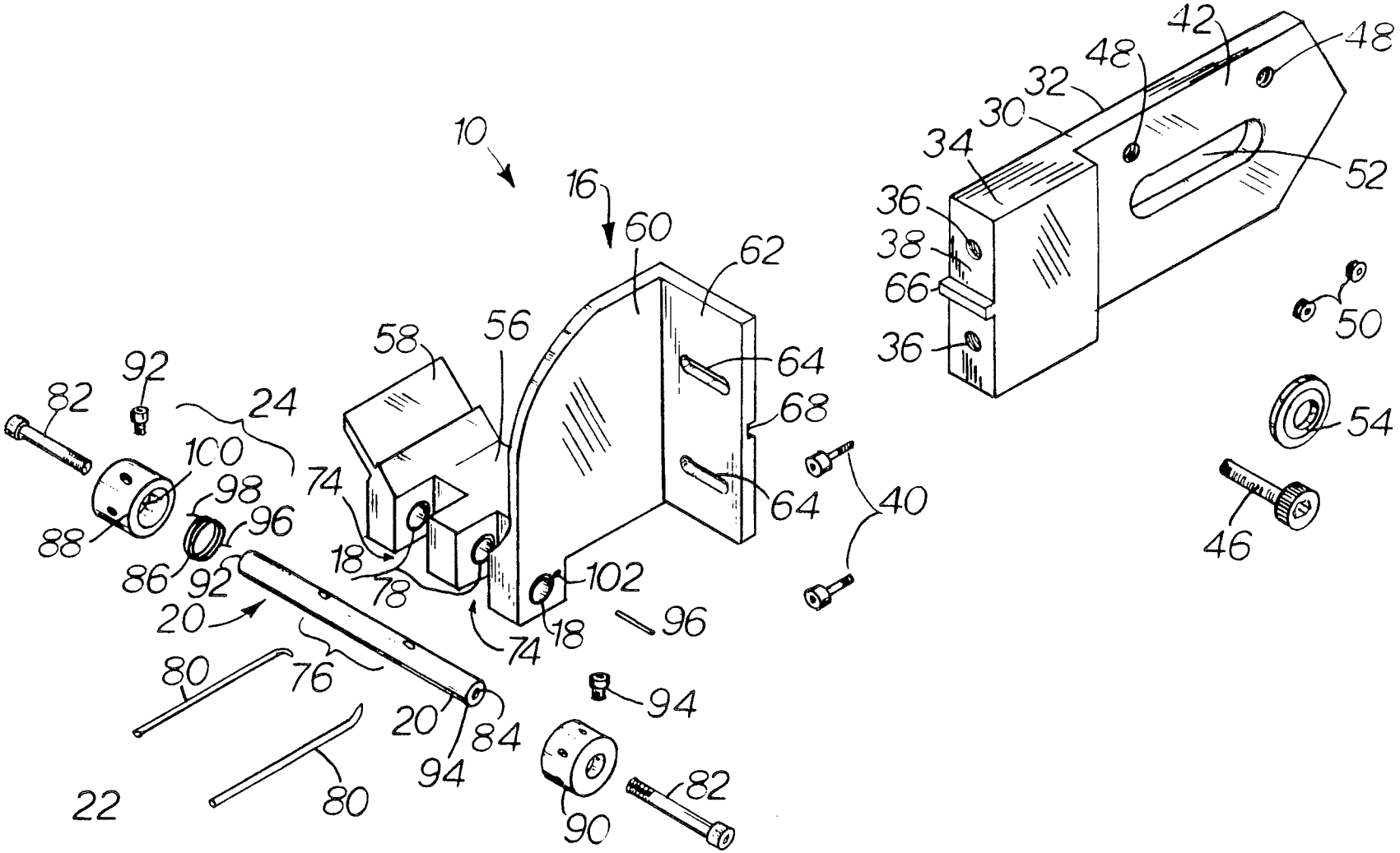
FIG. 2 is an isometric blow up of the component of one embodiment of arrow rest apparatus of this invention.

The arrow rest apparatus 10, as shown and illustrated on FIG. 2, contains an alignment tab 66. The alignment tab 66 is contained on the end 38 of the carriage mounting block 34, between the threaded bores 36. An alignment notch 68 is contained on the attachment bracket 62 between the slotted bores 64. The alignment tab 66 and notch 68 are for the horizontal placement and alignment of the carriage 16 on the mounting bracket 14.

Figure 3:
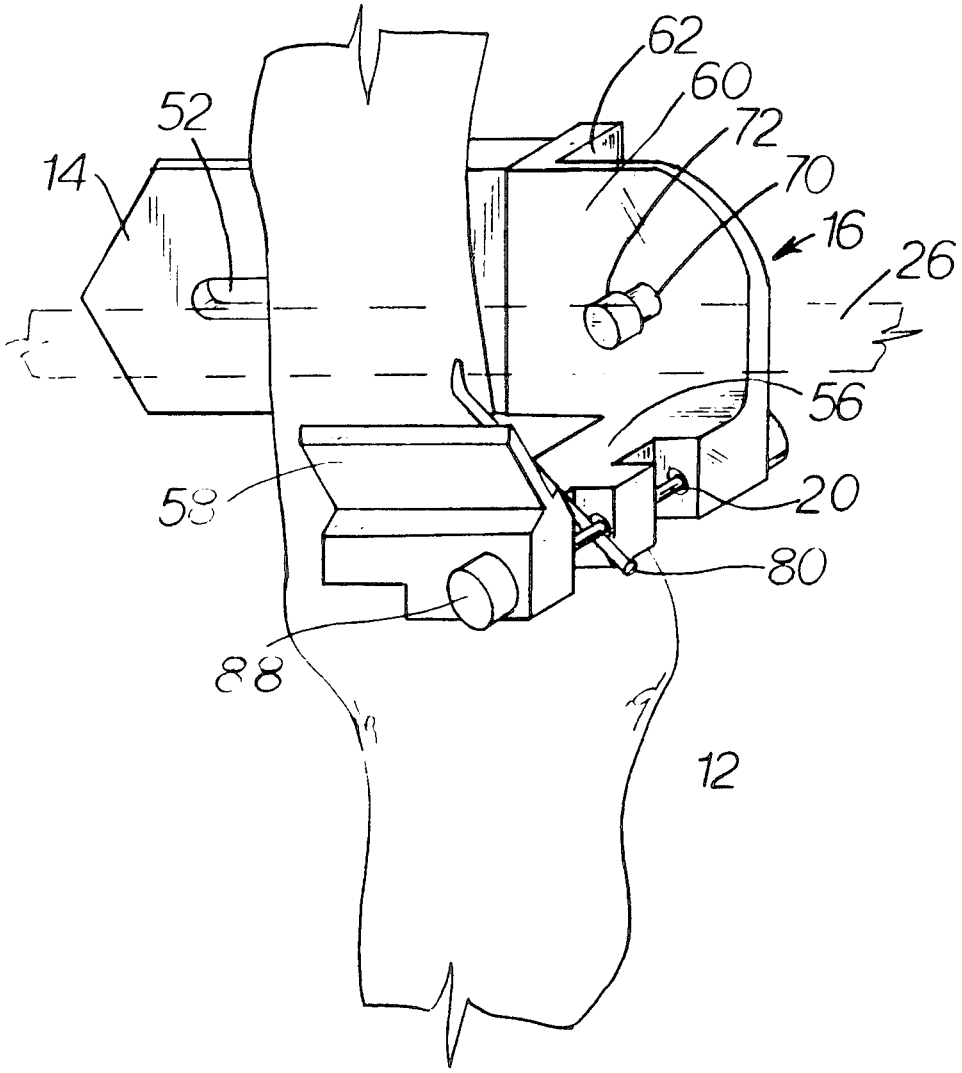
FIG. 3 illustrates the arrow rest apparatus in combination with a plunger type arrow rest.
Figure 4:
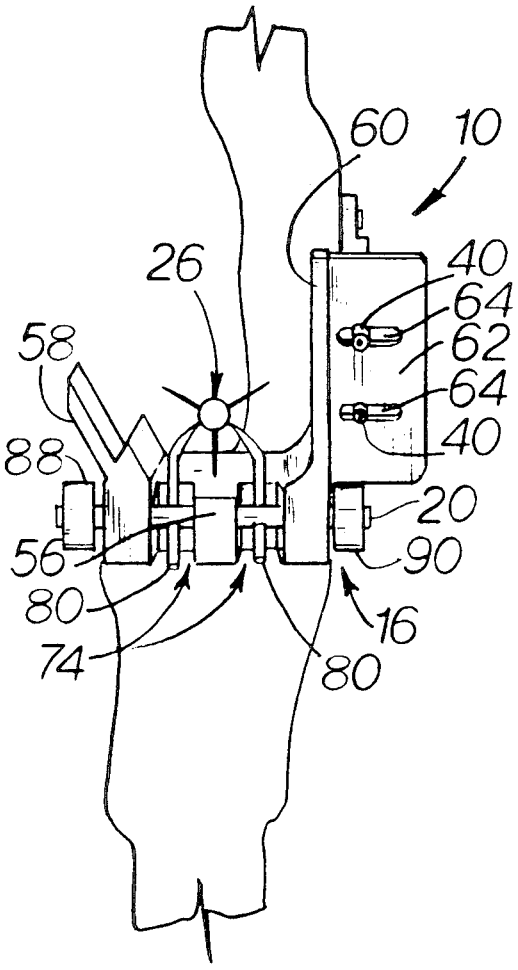
FIG. 4 is a view showing an arrow resting on two arrow resting fingers contained on the arrow rest apparatus of this invention.
Figure 5:
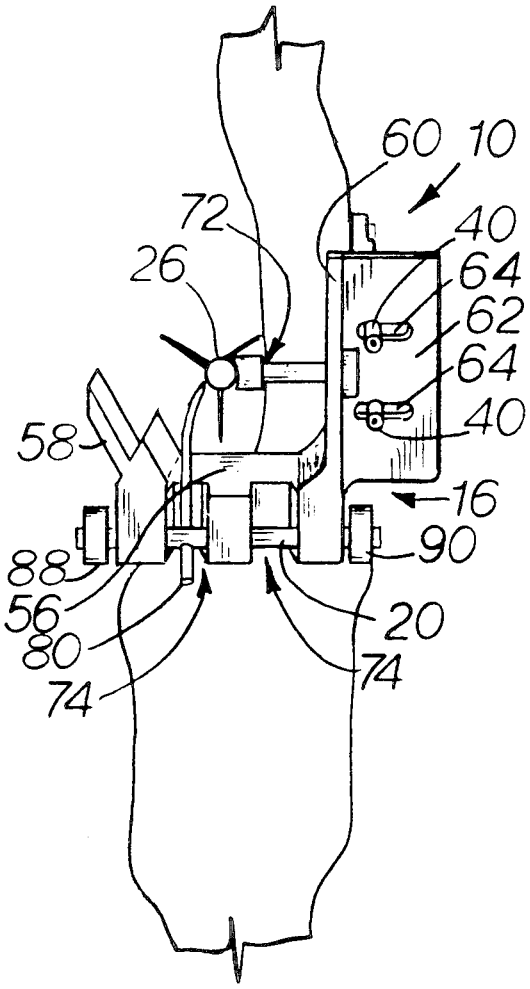
FIG. 5 is a view showing an arrow resting on a combination of a single arrow resting finger and a plunger type arrow rest.
Figure 6:
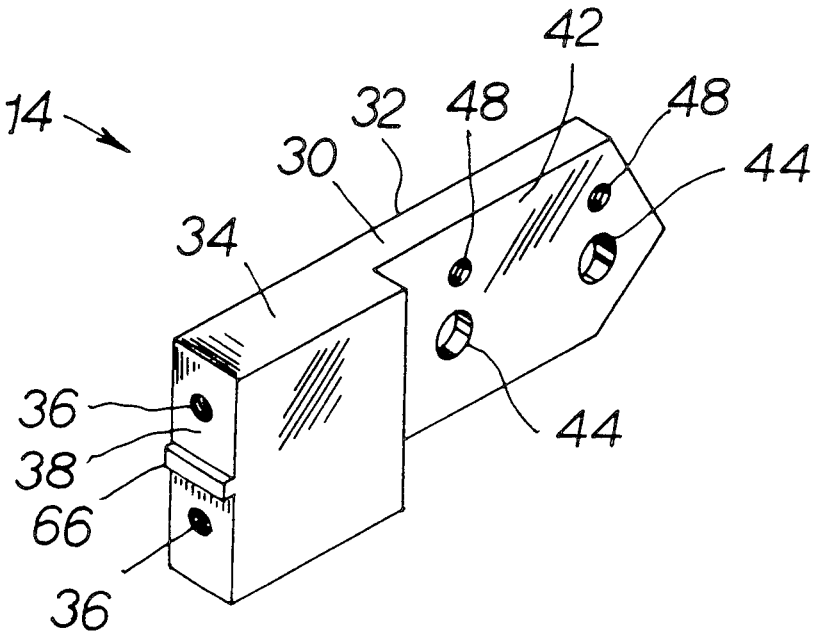
FIG. 6 is one embodiment of the mounting bracket.
Figure 7:
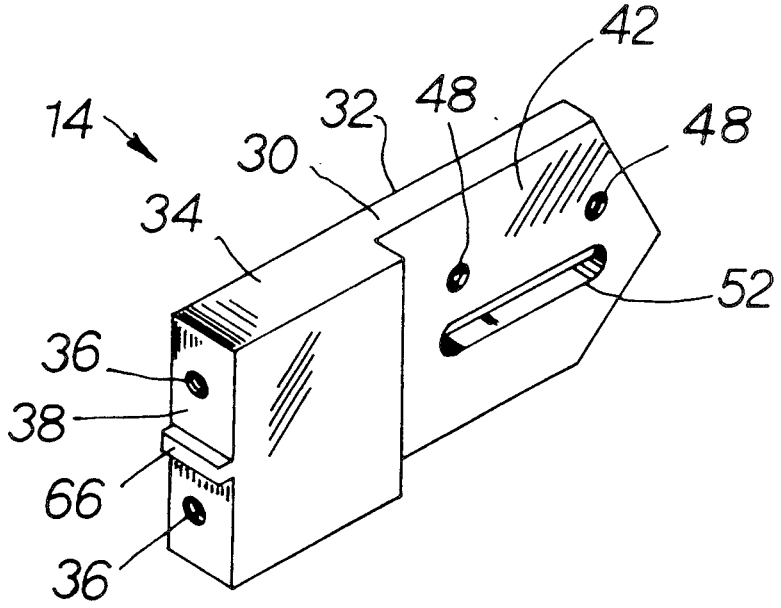
FIG. 7 is another embodiment of the mounting bracket.

The arrow rest apparatus 10 as shown and illustrated on FIG. 3, includes a threaded bore 70 and a plunger type arrow rest 72. The threaded bore 70 is contained on the right side wall 60 of the carriage 16. The threaded bore 70 is sized for receiving a plunger type of arrow rest 72. The plunger arrow rest 72 being used in conjunction with a single arrow resting means 22 attached to the rotatable arm 20. The plunger arrow rest 72 is known and is in common use with archers. Thus, the plunger arrow rest 72 is not specifically described in this detailed description. Rather, only the means of providing for the use is described. The use of the plunger arrow rest 72 is optional at the desire of the archer.

The right side wall 60 of carriage 16, if a threaded bore 70 is included, may be slightly wider then if no bore 70 is included. The extra width allows for additional room between the plunger arrow rest 72 and the attachment bolts 40.

A plurality of bushings 18 are contained within the main body 56 of the carriage 16. The bushings 18 are generally pressed into bores contained in the carriage 16. In another means of manufacture, a single bore is made in the main body 56 and the bushing material is pressed in. Once pressed in, the bushing material is bored to receive the rotatable arm 20. The bushing are separated by slotted openings 74. In the first method of manufacture, the slotted openings 74 are made prior to the insertion of the bushings 18. In the second, the slotted opening 74 are cut after insertion of the single bushing material. Cutting the slotted opening afterwards creates the multiple bushing of this invention.

The arrow rest apparatus in the preferred embodiment, has three bushings 18 perfectly aligned and contained within a main body 56 of the carriage 16. The bushings 18, in the preferred embodiment of this invention, are separated by rectangular slotted openings 74. The multiple bushings, of this invention, keep the rotatable arm holding the arrow resting means perfectly aligned for smoother operation and aiming. The multiple bushings also allows for a high degree of tolerance in maintaining the arrow resting means perfectly aligned.

A rotatable arm 20 is installed in the bushings 18. The rotatable arm 20 is freely rotatable within the bushings 18. The rotatable arm 20, in the preferred embodiment, is a single rotatable arm 20. However, a split rotatable arm could be used such that the arrow resting means 22 is split. In this situation, the arrow resting means on each side of the arrow 26 would rotate independent of the other. This feature may be desired by some archers.

The rotatable arm 20 contains an attachment means 76 for attachment of an arrow resting means 22 on said rotatable arm 20. The attachment means 76, in the preferred embodiment, consists of multiple lateral bores 78 through the rotatable arm 20. The lateral bores 78 receive the arrow resting means 22. The arrow resting means 22, in the preferred embodiment, consist of multiple hardened wire launching fingers 80. In other embodiments, the arrow resting means could consist of upward extended arms having a forked end or tines, flexible wire arrow supports or any other arrow resting support compatible within the scope and spirit of the inventive concepts described herein.

The fingers 80 are held securely in place by individual set screws 82. Each end of the rotatable arm 20 has a longitudinal threaded bore 84. The threaded bore 84 is bored past the lateral bores 78. The set screws 82 are screwed into the threaded bores 84. The set screws 82 are tightened against the fingers 80 which are positioned within the lateral bores 78. This securely holds the fingers 80 in position.

In the preferred embodiment, the rotatable arm 20 contains two lateral bores 78, for receiving two harden wire launching fingers 80. The rotatable arm 20 is positioned such that the lateral bores 78 are positioned in the slotted openings 74. This positioning results in the fingers 80 being positioned within the slotted openings 74.

Vertical adjustments of the arrow resting apparatus 10 is achieved by the vertical placement and position of the fingers 80 in the rotatable arm 20. In this configuration, each finger 80 is independently adjusted. There is an individual set screw 82 for each finger 80. Each set screw 82 securely hold one of the fingers 80. Yet, both fingers 80 are contained on the rotatable arm 20. This provides for equal and even rotation of the fingers 80 as they rotate out of position as the arrow 26 leaves the bow 12. This is desirable for a smooth and even departure from the bow 12, and a more accurate delivery of the arrow 26.

The biasing means 24, in the preferred embodiment, generally consists of a torsion spring 86 and a collar 88. Other types of biasing means such as a tension spring or other means could be used. The torsion spring 86 is mounted on the carriage 16, as such, to apply bias to the rotatable arm 20. The torsion spring 86 is contained within the collar 88. The torsion spring 86 and collar 88 being mounted over and around the end 92 of the rotatable arm 20. End 92 of rotatable arm 20 extends beyond the left side wall 58 of the carriage 16, leaving a sufficient space for the collar 88. One end 96 of the torsion spring 86 is connected to the side of carriage 16. A small bore may be provided to receive the end 96 in the side of carriage 16. The other end 98 of the torsion spring 86 is connected to the inside of the collar 88. A small bore 100 is provided on the inside of the collar 88 to receive the end 98. The collar 88 is rotatable and lockable on said rotatable arm 20. The collar is lockable by a screw 92 extending through the side of the collar 88. The screw 92 when tightened securely holds the collar 88 in position on rotatable arm 20. The bias to rotatable arm 20 thereby being adjustable by the rotation of the collar 88 and locking the collar to the rotatable arm 20 by the screw 92.

A second collar 90 is contained on the rotatable arm 20 on the right side of the carriage 16. This second collar 90 is similar to the collar 88 but generally, in the preferred embodiment, contains no bias spring. However, if addition biasing is required an additional torsion spring could easily be installed. This collar is locked on the rotatable arm 20 by screw 94. The screw 94 extending through the side of the second collar 90 and tightening against rotatable arm 20.

The screw 94 further function as a stop for limiting the rotation of the rotatable arm 20. As the rotatable arm 20 rotates the screw 94 extending on the outside of the second collar 90 also rotates. A stop pin 96 is positioned on the right side of the carriage 16. As the screw 94 rotates the screw encounters the stop pin 96 to limit and stop the rotation of the rotatable arm 20 at a specific position. The specific position being adjustable by the positioning of the second collar 90 on the rotatable arm 20. The second collar 90 being rotatable and lockable on rotatable arm 20. The stop pin 96 is typically pressed into a small bore 102 near the right most bushing 18 on the right side of the carriage 16.

The collar 88 and the second collar 90 once secured to the rotatable arm 20 prevent any horizontal movement of rotatable arm 20 within the bushings 18. Thus, these collars 88 and 90 secures the horizontal positioning of the rotatable arm 20 and the fingers 80 in the carriage 16.

An additional guard can be added to the arrow rest apparatus 10 without departing from the spirit and scope of this invention. This addition guard would be placed and mounted in front of the carriage 16 and would extend at least to the bow 12. This guard protects the hand of the archer in the event the arrow would somehow be released in a downward direction immediately in front of the carriage 16. This is a possible situation because of the carriage being in an "overdraw" position. This type of guard is optional by the archer and does not affect the operation and performance of the arrow rest apparatus.

The arrow rest apparatus 10 as described and illustrated is for a right handed archer. The arrow rest apparatus 10 of this invention also includes an arrow rest apparatus for left handed archers. In the left handed model all the components are reciprocal and a mirror image of the right handed model. Thus, the scope and spirit of the inventive concepts herein described also include the left hand model although not specifically described and illustrated.

In operation, the arrow rest apparatus 10 is mounted on a bow 12 as indicated above in this description. The mounting bracket 14 being mounted on the outside of the arrow window on bow 12, with the end of the mounting bracket 14 having the carriage attachment block 34 between the bow string and the bow. The carriage 16 is attached to the mounting bracket 14 by attachment bolts 40. The carriage is positioned and horizontally adjusted such that the center of the two fingers 80 is aligned with the line of travel of the bow string as it is released from a pulled back position. This assures a straight release of the arrow 26 as it leaves the bow 12. In this configuration the carriage is also positioned in an "overdraw" position. This means that the arrow rest is closer to the bow string than the arrow rest generally contained within the arrow window of the bow. This allows a shorter arrow 26 to be used, prevents the tip of an arrow 26 from falling off the inside of the arrow rest when the bow string is drawn back, and places the arrow rest nearer the feathered end of the arrow 26 when drawn back, which creates less of an interference to the arrow 26 as it bows and flexes as the arrow 26 leave the bow. A shorter arrow 26, if used, is stronger and faster then a longer arrow 26.

The arrow rest apparatus 10 of this invention allows all adjustments to be made independently from all the others. The horizontal adjustment is provided by loosing the attachment bolts 40 and repositioning of the carriage 16. Vertical adjustment and bias tension is not effected. Vertical adjustment is provided by the vertical placement of the fingers 80 in the rotatable arm 20. The position of each finger 80 being independent of the other. The fingers 80 being adjusted by loosing the respective set screw 82, repositioning and tightening the set screw 82. This would then be repeated for the other finger 80, if needed. Again the horizontal adjustment and the bias tension is not effected. The tension of the bias is adjustable by loosing the screw 92 in collar 88, rotating the collar 88 about the rotatable arm 20 until the desired tension is achieved and tightening the screw 92. Again the horizontal and vertical adjustments are not effected. The stop position of the rotatable arm 20 is adjustable, independently from all other adjustments, by loosing the screw 94 in the second collar 90, rotating the second collar 90 until the desired stop position is reached and tightening the screw 94.

The fingers 80 hold an arrow 26 in a desired position so that the archer can properly aim the bow 12 and arrow 26. As the string is released the arrow 26 is propelled forward. The propulsive force exerted on the arrow 26 causes the arrow 26 to flex and bow. The forward motion and the flexing and bowing causes the fingers to rotate forward about the rotatable arm 20. Thus, as the arrow 26 leaves the bow the fingers 80 are creating little of no interference in the projection of the arrow 26 from the bow.

In another embodiment of the arrow rest apparatus 10 of this invention a single finger 80 is mounted and positioned in the one of the lateral bores 78 in rotatable arm 20. A plunger type arrow rest 72 is positioned within the threaded bore 70 of the right side wall 60 of carriage 16. The arrow 26 rests upon the finger 80 and the head of the plunger 72 when aiming. When the arrow 26 is released the finger 80 rotates out of the way as described above. As the arrow 26 passes the head of plunger 72 the plunger action absorbs a portion of the sideways forces exerted on the head by the passing arrow 26. Some archers prefer this combination in shooting a bow. The sideways forces are created as the string is released from the archer's fingers. As the string slides off the fingers the sting moves slightly sideways thereby creating the sideways forces on the arrow 26 as it is released. The action of the plunger absorbs and compensates for a portion of the sideways forces and the oscillations created.

Having described the invention in detail, those skilled in the art will appreciate that modifications may be made of the invention without departing from the spirit of the inventive concept herein described. The particular shape, sizes, and configurations of the mounting bracket, carriage, rotatable arm, fingers and biasing means and the various adjustment means could be changed, altered or modified for any other particular application without departing from the spirit and scope of the invention herein described.

Therefore, it is not intended that the scope of the invention be limited to the specific and preferred embodiments illustrated and described. Rather, it is intended that the scope of the invention be determined by the appended claims and their equivalents.

What is claimed is:

1. An arrow rest apparatus for use in archery which comprises:

a mounting bracket for attaching said arrow rest apparatus to an archery bow;

a carriage attached to said mounting bracket;

a plurality of bushings, said bushing being aligned and contained within said carriage, said multiple bushings being separated by slotted openings between said multiple bushings in said carriage;

a rotatable arm installed in said bushings;

an attachment means on said rotatable arm for attachment of an arrow resting means on said rotatable arm; and a biasing means, said biasing means mounted on said carriage to apply bias to said rotatable arm.

2. An arrow rest apparatus as set forth in claim 1 in which said mounting bracket comprises:

a rectangular structure, said rectangular structure having a bow mounting area and a carriage mounting block, said bow mounting area being along an elongated section of said rectangular structure and having a plurality of bores, said bores for receiving a mounting bolt for attaching said mounting bracket to said archery bow, said bow mounting area further having a small threaded bore above said bores for receiving a set screw for stabilizing said arrow rest on said bow, and said carriage mounting block being attached to said rectangular structure at an end of said bow mounting area on said elongated section, and said carriage mounting block having multiple threaded bores for attachment of said carriage.

3. An arrow rest apparatus as set forth in claim 1 in which said mounting bracket comprises:

a rectangular structure, said rectangular structure having a bow mounting area and a carriage mounting block, said bow mounting area being along an elongated section of said rectangular structure and having an elongated slotted bore, said slotted bore for receiving a mounting bolt for attaching said mounting bracket to said archery bow, said bow mounting area further having a plurality of small threaded bores above said slotted bore for receiving a set screw for stabilizing said arrow rest on said bow, and said carriage mounting block being attached to said rectangular structure at an end of said bow mounting area on said elongated section, said carriage mounting block having multiple threaded bores for attachment of said carriage.

4. The arrow rest apparatus as set forth in claim 1 in which said carriage further comprises elongated slotted openings for receiving attachment bolts, said attachment bolts for attaching said carriage to said mounting bracket, said elongated slotted openings for providing horizontal adjustment of said arrow rest apparatus.

5. The arrow rest apparatus as set forth in claim 1 in which said carriage comprises of a main body, a left side wall extending at an angle from the left side of said main body, a right side wall extending from the right side of said main body, and an attachment bracket extending at a right angle from said right wall.

6. The arrow rest apparatus as set forth in claim 5 in which said multiple bushings are aligned and contained within said main body of said carriage.

7. The arrow rest apparatus as set forth in claim 5 in which the left side wall functions as a guard to prevent an arrow being shot from said bow from falling off said arrow rest on the left side.

8. The arrow rest apparatus as set forth in claim 5 wherein said carriage further comprising a threaded bore on said right side wall, said threaded bore for receiving a plunger type of arrow rest, said plunger type of arrow rest being used in conjunction with a single arrow resting means attached to said rotatable arm.

9. The arrow rest apparatus as set forth in claim 1 in which said arrow rest apparatus further comprises an alignment tab contained on said mounting bracket at an area on which said carriage is attached and an alignment notch contained on said carriage for insertion of said alignment tab for the horizontal alignment of said carriage on said mounting bracket during the attachment of said carriage.

10. The arrow rest apparatus as set forth in claim 1 in which said attachment means for attachment of an arrow resting means comprises multiple lateral bores through said rotatable arm and set screws, said set screws being screwable into threaded longitudinal bores contained within said rotatable arm.

11. The arrow rest apparatus as set forth in claim 1 in which said biasing means comprising a torsion spring contained within a collar, said torsion spring and collar being put over and around said rotatable arm, one end of said torsion spring connected to said carriage, the other end of said torsion spring being connected to said collar, said collar being lockable on said rotatable arm, thereby providing an adjustable biasing means to said rotatable arm.

12. The arrow rest apparatus as set forth in claim 1 in which said arrow resting means comprising multiple hardened wire launching fingers, said launching fingers being mountable on said rotatable arm.

13. An arrow rest apparatus for use in archery which comprises:

a mounting bracket for attaching said arrow rest apparatus to an archery bow, said mounting bracket comprising, a rectangular structure, said rectangular structure having a bow mounting area and a carriage mounting block, said bow mounting area being along an elongated section of said rectangular structure and having an attachment means for attaching said mounting bracket to said bow, and said carriage mounting block being attached to said rectangular structure at an end of said bow mounting area on said elongated section, and said carriage mounting block having multiple threaded bores for attachment of said carriage;

a carriage attached to said mounting bracket, said carriage comprising a main body, a left side wall extending at an angle from the left side of said main body, a right side wall extending from the right side of said main body, and an attachment bracket extending at a right angle from said right wall, said attachment bracket having bores for receiving bolts to attach said carriage to said threaded bores on said carriage mounting block;

a plurality of bushings, said bushings being aligned and contained within said main body of said carriage, said carriage further containing slotted openings between and separating said multiple bushings aligned in said carriage;

a rotatable arm installed in said bushings;

an attachment means on said rotatable arm for attachment of an arrow resting means on said rotatable arm, said attachment means comprising multiple lateral bores through said rotatable arm and set screws, said set screws being screwable into threaded longitudinal bores contained within said rotatable arm; and a biasing means, said biasing means mounted on said carriage to apply bias to said rotatable arm, said biasing means comprising a torsion spring contained within a collar, said torsion spring and collar being put over and around said rotatable arm, one end of said torsion spring connected to said carriage, the other end of said torsion spring being connected to said collar, said collar being lockable on said rotatable arm, thereby providing an adjustable biasing means to said rotatable arm.

14. The arrow rest apparatus as set forth in claim 13 in which said attachment bracket on said carriage contains slotted bores for the horizontal adjustment of said arrow rest apparatus.

15. The arrow rest apparatus as set forth in claim 13 wherein said carriage further comprising a threaded bore on said right side wall, said threaded bore for receiving a plunger type of arrow rest, said plunger type of arrow rest being used in conjunction with a single arrow resting means attached to said rotatable arm.

16. The arrow rest apparatus as set forth in claim 13 in which said arrow rest apparatus further comprises an alignment tab contained on said carriage mounting block and an alignment notch contained on said attachment bracket on said carriage for insertion of said alignment tab for the horizontal alignment of said carriage on said mounting bracket during the attachment of said carriage.

17. A method of providing an arrow rest apparatus for use in archery which comprises the following steps:

providing a mounting bracket for attaching said arrow rest apparatus to an archery bow;

attaching a carriage to said mounting bracket;

aligning and containing a plurality of bushings within said carriage;

separating said plurality of bushings with slotted openings between said bushings;

installing a rotatable arm in said bushings;

attaching an arrow resting means on said rotatable arm; and mounting a biasing means on said carriage to apply bias to said rotatable arm.

18. A combination archery bow and an arrow rest apparatus for use in archery which comprises:

an archery bow, said archery bow having a string for propelling an archery arrow, a handle for the archer to grip said archery bow, and an arrow window defined by said bow above said handle, said window having a bore for receiving an arrow rest;

an arrow rest apparatus which comprises:

a mounting bracket for attaching said arrow rest apparatus to said archery bow;

a carriage attached to said mounting bracket;

a plurality of bushings, said bushing being aligned and contained within said carriage, said bushings being separated by slotted openings between said bushings in said carriage;

a rotatable arm installed in said bushings;

an attachment means on said rotatable arm for attachment of an arrow resting means on said rotatable arm; and a biasing means, said biasing means mounted on said carriage to apply bias to said rotatable arm.

19. A combination archery bow and an arrow rest apparatus for use in archery which comprises:

an archery bow, said archery bow having a string for propelling an archery arrow, a handle for the archer to grip said archery bow, and an arrow window defined by said bow above said handle, said window having a bore for receiving an arrow rest;

an arrow rest apparatus comprising:

a mounting bracket for attaching said arrow rest apparatus to said archery bow, said mounting bracket comprising, a rectangular structure, said rectangular structure having a bow mounting area and a carriage mounting block, said bow mounting area being along an elongated section of said rectangular structure and having an attachment means for attaching said mounting bracket to said bow, and said carriage mounting block being attached to said rectangular structure at an end of said bow mounting area on said elongated section, and said carriage mounting block having multiple threaded bores for attachment of said carriage;

a carriage attached to said mounting bracket, said carriage comprising a main body, a left side wall extending at an angle from the left side of said main body, a right side wall extending from the right side of said main body, and an attachment bracket extending at a right angle from said right wall, said attachment bracket having bores for receiving bolts to attach said carriage to said threaded bores on said carriage mounting block;

a plurality of bushings, said bushings being aligned and contained within said main body of said carriage, said carriage further containing slotted openings between and separating said multiple bushings aligned in said carriage;

a rotatable arm installed in said bushings;

an attachment means on said rotatable arm for attachment of an arrow resting means on said rotatable arm, said attachment means comprising multiple lateral bores through said rotatable arm and set screws, said set screws being screwable into threaded longitudinal bores contained within said rotatable arm; and a biasing means, said biasing means mounted on said carriage to apply bias to said rotatable arm, said biasing means comprising a torsion spring contained within a collar, said torsion spring and collar being put over and around said rotatable arm, one end of said torsion spring connected to said carriage, the other end of said torsion spring being connected to said collar, said collar being lockable on said rotatable arm, thereby providing an adjustable biasing means to said rotatable arm.

20. An arrow rest apparatus for use in archery which comprises:

a mounting bracket for attaching said arrow rest apparatus to an archery bow;

a carriage attached to said mounting bracket;

three bushings, said bushings being aligned and contained within said carriage, said bushings being separated by rectangular slotted openings between said bushings aligned in said carriage;

a rotatable arm installed in said bushings;

an attachment means on said rotatable arm for attachment of an arrow resting means on said rotatable arm; and a biasing means, said biasing means mounted on said carriage to apply bias to said rotatable arm.

* * * * *